US007591389B2

(12) United States Patent
Wong

(10) Patent No.: US 7,591,389 B2
(45) **Date of Patent: *Sep. 22, 2009**

(54) DRINKING CUP LID WITH SELF-SECURING SLIDING MEMBER

(75) Inventor: Joseph Chuek Mau Wong, Daly City, CA (US)

(73) Assignee: Double Team Inc., Daly City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/109,988

(22) Filed: Apr. 25, 2008

(65) Prior Publication Data

US 2008/0190946 A1 Aug. 14, 2008

Related U.S. Application Data

(63) Continuation-in-part of application No. 11/419,163, filed on May 18, 2006.

(51) Int. Cl.
*B65D 51/18* (2006.01)
*B65D 41/18* (2006.01)
*A47G 19/22* (2006.01)

(52) U.S. Cl. ..... 220/254.9; 220/711; 220/713; 220/714; 220/715; 220/780

(58) Field of Classification Search ..... 220/254.1, 220/254.3, 345.1–345.4, 713–715, 780; 229/404; 222/509

See application file for complete search history.

(56) References Cited

U.S. PATENT DOCUMENTS 2,475,896 A 7/1949 Husted
2,480,733 A 8/1949 Hermani
3,174,661 A 3/1965 Speicher
3,938,690 A 2/1976 Butler
4,057,167 A 11/1977 Lee
4,127,212 A 11/1978 Waterbury
4,170,724 A 10/1979 Waterbury
4,441,624 A 4/1984 Sokolowski
5,090,584 A 2/1992 Roberts et al.
5,197,624 A 3/1993 Dodaro
5,490,609 A 2/1996 Lane et al.
5,613,619 A 3/1997 Van Melle
5,699,927 A 12/1997 Lane et al.

(Continued)

FOREIGN PATENT DOCUMENTS

FR 2295889 7/1976

(Continued)

*Primary Examiner*—Robin A. Hylton
(74) *Attorney, Agent, or Firm*—Pinnacle Patent Law Group

(57) ABSTRACT

A disposable lid for a drinking cup includes a cover portion and a sliding member that is configured to slidably fit into a trench in the cover portion. The trench includes a drink opening on a floor of the trench and the sliding member is configured to cover and uncover the drink opening. In one embodiment, the sliding member includes side portions that extend longitudinally and upwardly from a central portion of the sliding member such that an outer edge of each side portion is located above the central portion of the sliding member. A gap width between the outer edges of the side portions of the sliding member is greater than a width of a mouth of the trench such that the side portions of the sliding member secure the siding member to the cover portion.

14 Claims, 6 Drawing Sheets

U.S. PATENT DOCUMENTS

| | | | |
|---|---|---|---|
| 5,947,323 | A | 9/1999 | Freek et al. |
| D417,845 | S | 12/1999 | Sadlier et al. |
| D418,363 | S | 1/2000 | Barnes et al. |
| 6,089,397 | A | 7/2000 | Van Melle |
| 6,260,727 | B1 | 7/2001 | Durdon |
| D447,412 | S | 9/2001 | Durdon |
| 6,354,454 | B1 | 3/2002 | Wong |
| 6,505,753 | B1 | 1/2003 | Freek et al. |
| D476,566 | S | 7/2003 | Smith et al. |
| D477,223 | S | 7/2003 | Smith et al. |
| D478,006 | S | 8/2003 | Smith et al. |
| 6,612,456 | B1 | 9/2003 | Hundley et al. |
| D489,260 | S | 5/2004 | Smith et al. |
| D493,718 | S | 8/2004 | Durdon |
| 6,889,860 | B2 | 5/2005 | Mazzarolo |
| 6,929,143 | B2 | 8/2005 | Mazzarolo |
| 6,948,633 | B2 | 9/2005 | Freek et al. |
| D514,444 | S | 2/2006 | Smith et al. |
| D514,445 | S | 2/2006 | Smith et al. |
| D533,779 | S | 12/2006 | Schmidtner et al. |
| 2005/0092749 | A1 | 5/2005 | Durdon |
| 2006/0081633 | A1 | 4/2006 | Schmidtner et al. |
| 2007/0278228 | A1 * | 12/2007 | Wong ..... 220/254.9 |

FOREIGN PATENT DOCUMENTS

| | | | |
|---|---|---|---|
| FR | 2780385 | A1 * | 12/1999 |
| GB | 239036 | | 9/1925 |
| GB | 497184 | | 4/1934 |

* cited by examiner

DRINKING CUP LID WITH SELF-SECURING SLIDING MEMBER

CROSS-REFERENCE TO RELATED APPLICATION

This application is a continuation-in-part of U.S. patent application Ser. No. 11/419,163, filed May 18, 2006, the disclosure of which is incorporated herein by reference in its entirety.

FIELD OF THE INVENTION

The present invention relates to a disposable lid for a drinking cup and more particularly to a disposable lid having a slidable drink opening cover.

BACKGROUND OF THE INVENTION

A disposable lid is typically secured over a disposable beverage cup to prevent a beverage from spilling out of the cup. The lid typically has a preformed opening that allows a user to drink the beverage without removing the lid from the cup. Nevertheless, these lids can be problematic because the beverage can spill out of the opening if the user is bumped or if the cup is overturned.

To address this problem, many lids provide a covering member to cover the drink opening when the user is not drinking the beverage. One type of lids includes a resealable drinking flap that may be either pushed into the lid or pulled away from the lid to form the opening. One disadvantage of this type of lid, however, is that it is difficult to manipulate the flap with one hand while holding the cup with the same hand.

Other types of lids have a slidable member that can slide over the drink opening. These lids typically include a lip protruding up from the top surface of the lid and around the circumference of the lid, and the drink opening is typically positioned on the top surface of the lid. Thus, the lip forms a wall around the opening. One disadvantage of this type of lid, however, is that the lip makes it difficult for the user to place his or her mouth directly against the opening. So during drinking, the beverage can leak out of the opening and drip onto the user.

A lid for a nondisposable commuter mug utilizes an H-shaped flap that slides over a preformed opening, which alleviates spillage. Nevertheless, such a lid for a commuter mug is not disposable, is bulky and is relatively expensive to manufacture. Moreover, the H-shaped flap design is not feasible for a disposable lid because the disposable lid is typically manufactured from a thin plastic material that does not exhibit the rigidity required to produce an effective H-shaped flap.

Accordingly, a need exists for a disposable lid for a cup that has an opening through which a user can easily drink a beverage without removing the lid. The lid should prevent the beverage from spilling out of the cup when the user is not drinking from the cup and when the user is drinking. The user should be able to manipulate the lid with one hand. In addition, the lid should be relatively inexpensive to manufacture, and easy to assemble and store.

SUMMARY OF THE INVENTION

In one embodiment, a disposable lid for a drinking cup includes a cover portion having a generally circular periphery and a sliding member that is configured to slidably fit into a trench in the cover portion. The trench extends longitudinally along a top surface of the cover portion and has an open end at the periphery of the cover portion. The trench includes a drink opening in the floor of the trench adjacent to the periphery and a guide slot on the floor of the trench. The sliding member includes side portions joined by a central portion. Each side portion extends upwardly from the central portion such that the outer edges of the side portions are above the central portion and a gap width between the outer edges is greater than a width of a mouth of the trench such that the side portions of the sliding member secure the siding member to the cover portion. The siding member also includes a handle extending upward from a top surface of the sliding member and a guide extending downwardly from the central portion of the sliding member so that the guide slidably fits into the guide slot on the floor of the trench. The guide slot allows the sliding member to move between a first position and a second position via the guide, such that when the sliding member is in the first position, the sliding member covers the drink opening and when the sliding member is in the second position, the sliding member uncovers the drink opening.

In another embodiment, the trench includes longitudinal side walls that extend downwardly and outwardly from the top surface of the cover portion to form an overhang portion such that the width of the floor of the trench is greater than the width of the mouth of the trench. In this embodiment, the gap width between the outer edges of the side portions of the sliding member is greater than the width of the mouth of the trench such that when the sliding member is in the trench, the sliding member is securely attached to the cover portion via the overhang portion.

In another embodiment, the trench includes longitudinal side walls that extend downwardly and outwardly from the top surface of the cover portion for a first distance, then extend inwardly toward a center of the trench for a second distance to form a notched portion, and then extend downwardly toward the floor of the trench. In addition, at least one side portion of the sliding member further comprises a ridge extending outwardly away from the central portion of the sliding member to form a ridge portion, wherein the ridge portion of the sliding member fits in the notched portion of the trench and the gap width between the outer edges of the side portions is greater than a width of the mouth of the trench such that when the sliding member is in the trench, the sliding member is securely attached to the cover portion via the notched portion.

DESCRIPTION OF THE INVENTION

The present invention relates to a disposable lid for a drinking cup and more particularly to a disposable lid having a slidable drink opening cover. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

According to one embodiment, the disposable lid includes a cover portion that has a trench on the top surface. The trench runs from approximately the center of the cover portion to a periphery, where the trench is open ended. A drink opening is provided in the trench near the open end of the trench and the periphery. The lid also includes a sliding member that is configured to sit in the trench. In one embodiment, the sliding member comprises side portions that extend upwardly from a central portion that runs longitudinally along the sliding member. The outer edges of the side portions are above the central portion and a gap width between the outer edges is greater than a width of the trench's mouth such that the sliding member is securely attached to the cover portion via the side portions.

In one embodiment, the sliding member is configured to slide within the trench between a first position and a second position. In the first position, the sliding member covers the drink opening, while in the second position, the sliding member uncovers the drink opening. The trench includes a guide slot on a bottom surface of the trench that is configured to receive a guide on the sliding member. The guide slot prevents the sliding member from moving beyond the periphery and in one embodiment, securely attaches the sliding member to the cover portion.

Through the aspects of the present invention, the user can hold the cup with one hand and, with the same hand, easily cover and uncover the drink opening. Thus, when the user is not drinking, the user can cover the opening and prevent the beverage from spilling out of the cup. Because the trench is open ended, the user can place his or her mouth directly on the drink opening thereby reducing the risk of spilling the beverage during drinking.

Figure 1A:
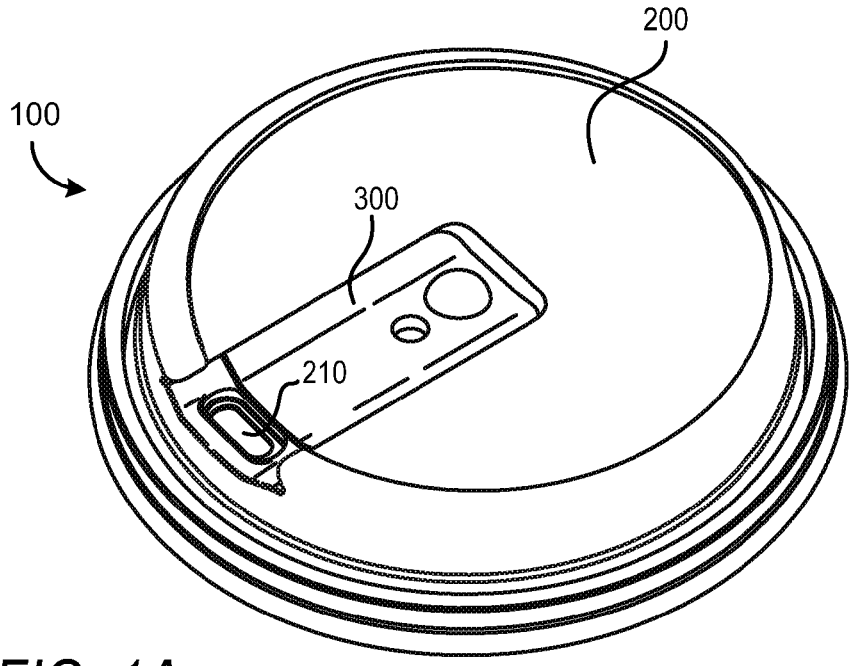
FIGS. 1A and 1B are perspective views of an exemplary lid in a drinking and non-drinking configuration, respectively, according to one embodiment.
Figure 1B:
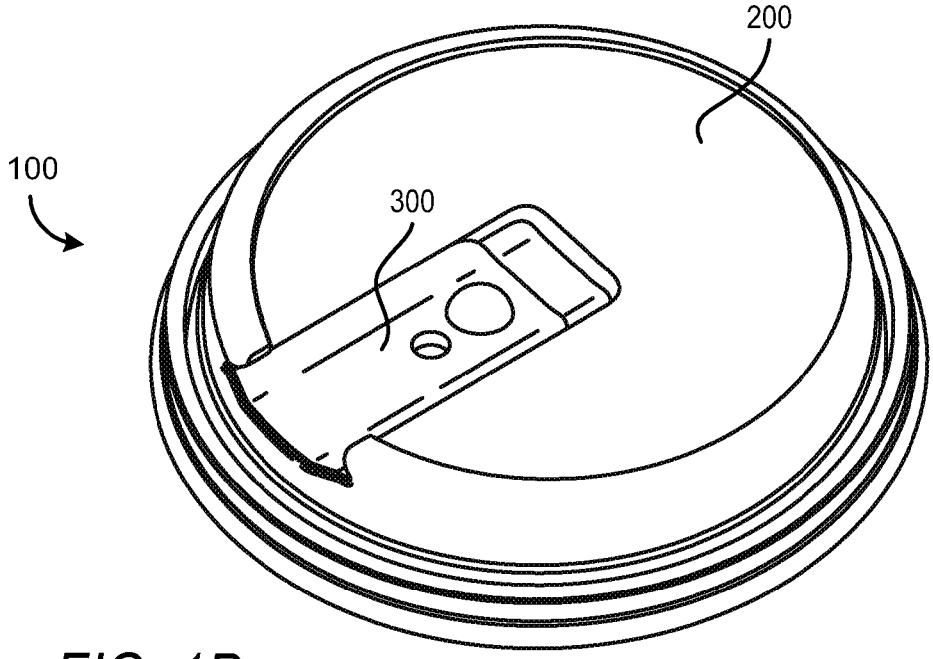

FIGS. 1A and 1B are perspective views of a disposable lid in a drinking and a non-drinking position, respectively, according to one exemplary embodiment. The disposable lid 100 comprises a cover portion 200 and a sliding member 300 that uncovers a drink opening 210 when a user is drinking, as shown in FIG. 1A, and covers the drink opening 210 when the user is not drinking, as shown in FIG. 1B.

Figure 2A:
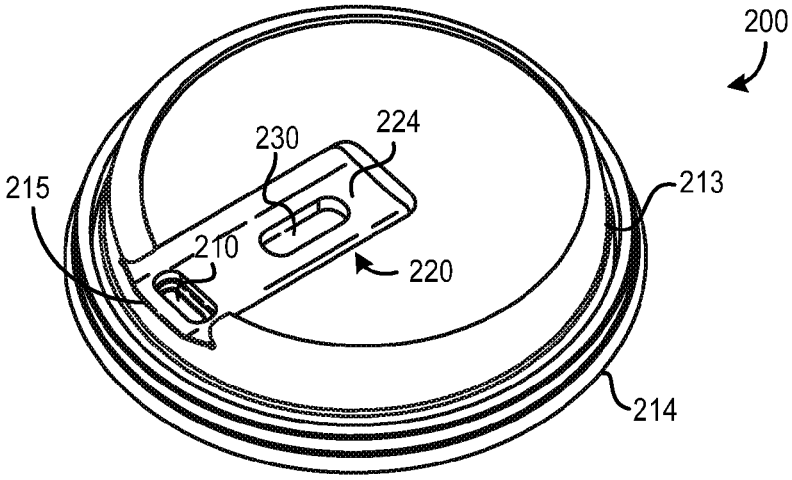
FIG. 2A and FIG. 2B are perspective and top views, respectively, of a cover portion of the lid in accordance with one embodiment.
Figure 2B:
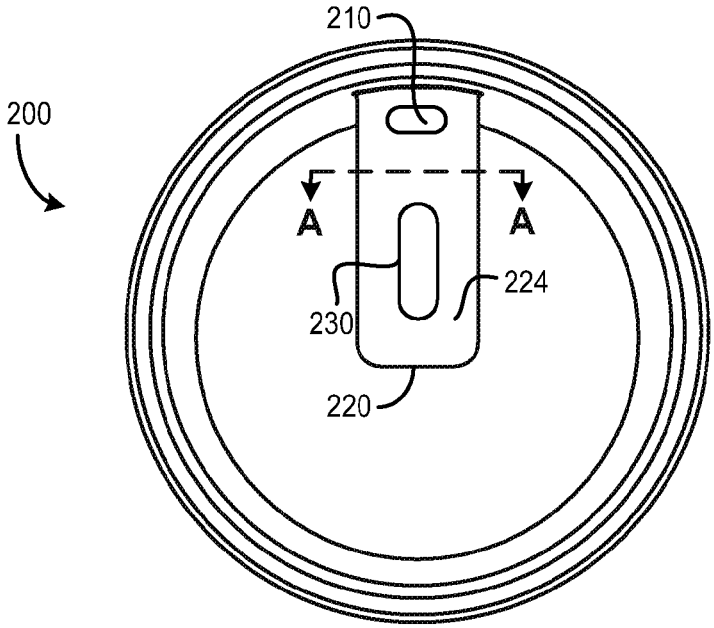

FIG. 2A and FIG. 2B are perspective and top views, respectively, of the cover portion 200 of the lid according to one embodiment of the present invention. Referring to FIG. 2A and FIG. 2B, the cover portion 200 has a generally circular periphery 215, and includes an annular side wall 213 that extends downward from the periphery 215 to an annular mounting portion 214, which secures the cover portion 200 on the cup (not shown).

According to one embodiment, the cover portion 200 includes a trench 220 that extends longitudinally from approximately a center of the cover portion 200 to the periphery 215. The trench has an open end at the periphery 215 and a floor 224. Adjacent to the periphery 215, the trench 220 includes a drink opening 210 in the floor 224 that allows the user to drink from the cup without removing the lid 100. In addition, a guide slot 230 is also located on the floor 224 of the trench. The guide slot 230 is configured to limit the movement of the sliding member 300 between the first and second positions. In the embodiment, the guide slot 230 can form an opening through the cover portion 200. In another embodiment, the guide slot 230 can forms a second trench in the floor 224 the trench 220. In this embodiment, the second trench can be more resilient and less resistant to tearing because it is one continuous piece. Accordingly, the structural integrity of the cover portion 200 can be improved.

Figure 3A:
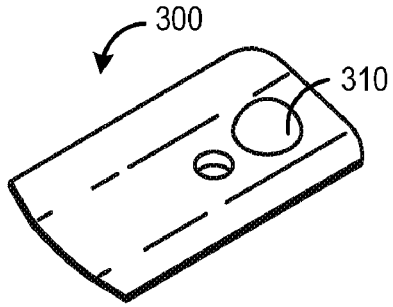
FIGS. 3A, 3B, and 3C are perspective top, perspective bottom, and top views, respectively, of a sliding member according to one embodiment.
Figure 3B:
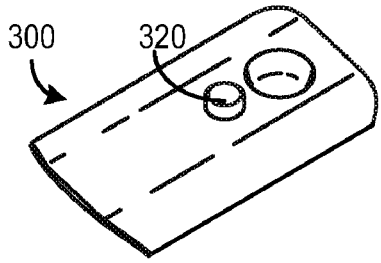
Figure 3C:
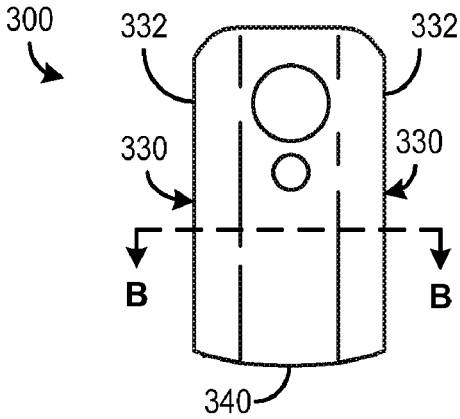

FIGS. 3A, 3B, and 3C are perspective top, perspective bottom, and top views, respectively, of a sliding member 300 configured to slidably fit into the trench 220 according to one embodiment. As is shown in FIG. 3A, the sliding member 300 includes a handle 310 that extends upwardly from a top surface of the sliding member 300 and that allows the user to move the sliding member 300 within the trench 220. The sliding member 300 also includes side portions 330 joined by a central portion 340 extending longitudinally along the sliding member 300. A guide 320 extends downwardly from the central portion 340 of the sliding member 300 and is configured to slidably fit into the guide slot 230 on the floor 224 of the trench.

In one embodiment, a size of the guide 320 is correlated to a length of the guide slot 230 such that when a front end of the guide 320 abuts a front end of the guide slot 230, the sliding member 300 is in the first position and covers the drink opening 210 (as shown in FIG. 1B), and when a back end of the guide 320 abuts a back end of the guide slot 230, the sliding member 300 is in the second position (as shown in FIG. 1A). Accordingly, the interaction between the guide 320 and the guide slot 230 prevents the sliding member 300 from extending beyond the periphery 215 of the cover portion 200. While the guide 320 and guide slot 230 prevent the sliding member 300 from slipping out of the trench 220 through its open end at the periphery 215, the side portions 330 of the sliding member 300 prevent the sliding member 300 from slipping out of the trench 220 through the mouth, i.e., the top, of the trench 220.

Figure 4A:
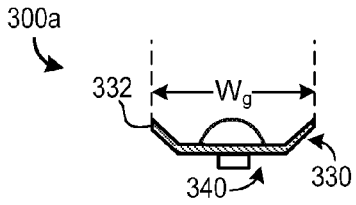
FIGS. 4A-4C are cross-sectional views of the sliding member taken along line B-B in FIG. 3C according to several embodiments.
Figure 4B:
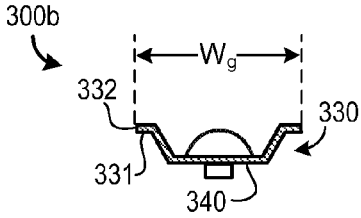
Figure 4C:
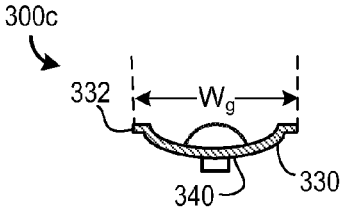

FIGS. 4A-4C are exemplary cross-sectional views of the sliding member 300 taken along line B-B in FIG. 3C according to several embodiments. Referring first to FIG. 4A, in this embodiment, each of the side portions 330 extends upwardly from the central portion 340 of the sliding member 300*a* such that an outer edge 332 of each side portion 330 is located above the central portion 340 of the sliding member 300. The side portions 330 can extend upwardly at an obtuse angle from the central portion 340 of the sliding member, as shown in FIG. 4A, or can extend upwardly at a right angle or an acute angle in other embodiments. According to an exemplary embodiment, a gap width, $W_g$, between the outer edges 332 of the side portions 330 is greater than a width, $W_m$, of the mouth of the trench 220. Because the mouth of the trench 220 is more narrow than the outer edges 332 of the side portions 330 of the sliding member 300*a*, the sliding member 300*a* cannot easily be removed from the top of the trench 220.

Figure 5A:
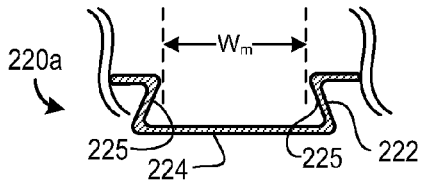
FIGS. 5A-5C are cross-sectional views of the trench taken along line A-A in FIG. 2B according to several embodiments.
Figure 5B:
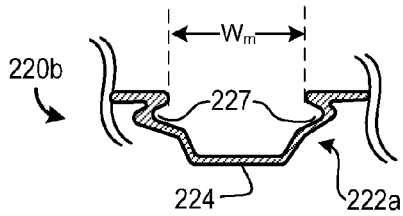
Figure 5C:
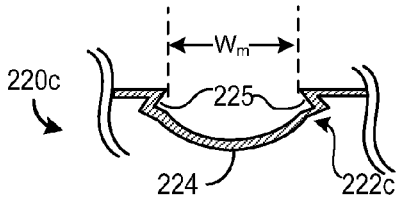

For example, FIGS. 5A-5C are exemplary cross-sectional views of the trench 220 taken along line A-A in FIG. 2B according to several embodiments. In FIG. 5A, the trench 220*a* includes longitudinal sidewalls 222 that can extend downwardly and outwardly from the top surface of the cover portion to form an overhang portion 225 such that a width of the floor 224 of the trench is greater than the width of the mouth, $W_m$, of the trench 220*a*. When the sliding member 300*a* shown in FIG. 4A is placed in this trench 220*a*, the sliding member 300*a* can be securely attached to the cover portion 200 via the overhang portion 225 of the trench 220*a*.

In another exemplary embodiment, shown in FIG. 5B, the trench 220*b* can have longitudinal side walls 222*a* that extend downwardly and outwardly from the top surface of the cover portion for a first distance, then extend inwardly toward a center of the trench 220*b* for a second distance to form a notched portion 227, and then extend downwardly toward the floor 224 of the trench. In this embodiment, the sliding member 300*b*, shown in FIG. 4B, can have at least one side portion 330 that further comprises a ridge extending outwardly away from the central portion 340 of the sliding member 300*b* to form a ridge portion 331, which is configured to fit in the notched portion 227 of the trench 220*b*. In this embodiment, the gap width, $W_g$, between the outer edges 332 of the side portions 330 is greater than the trench's mouth width, $W_m$, so that when the sliding member 300*b* is placed in the trench 220*b*, the sliding member 300*b* can be securely attached to the cover portion 200 via the notched portion 227.

While the exemplary trenches and sliding members described have substantially planar surfaces, other configurations are possible. For example, referring to FIG. 5C, the longitudinal side walls 222*c* can extend downwardly and outwardly from the top surface of the cover portion to form an overhang portion 225 and then curve downwardly toward the center of the trench such that the floor of the trench includes a curved surface. Similarly, referring to FIG. 4C, the central portion 340 of the sliding member 300*c* can also be curved to substantially match the curved surface of the floor the central portion of the sliding member is curved to substantially match the curved surface of the floor of the trench 224 of the trench 220*c*.

Although the embodiments of the sliding members 300*a*-300*c* and trenches 220*a*-220*c* have been described in pairs, each can be implemented effectively in various combinations. For example, the sliding member 300*b* shown in FIG. 4B can be implemented effectively in the trenches 220*a*, 200*c* shown in FIGS. 5A and 5C, as well as being implemented with the trench 220*b* shown in FIG. 5B as described.

In addition, in another embodiment, the sliding member 300 can be further attached to the cover portion 200 through the guide 320 and the guide slot 230. Referring again to FIG. 2B and FIG. 3B, the guide slot 230 can form an opening having an opening width, $W_o$, and the guide 320 can have flared sidewalls (not shown) such that the top of the guide 320 is more narrow than the bottom of the guide 320. The sliding member 300, in this embodiment, can be further secured to the cover portion 200 when the top of the guide 320 is more narrow and the bottom of the guide 320 more wide than the width of the opening, $W_o$, of the guide slot 230.

Figure 6A:
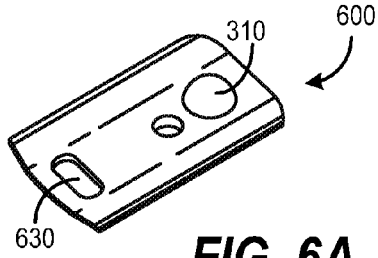
FIGS. 6A-6C are perspective top, perspective bottom, and top views, respectively, of a sliding member according to another embodiment.
Figure 6B:
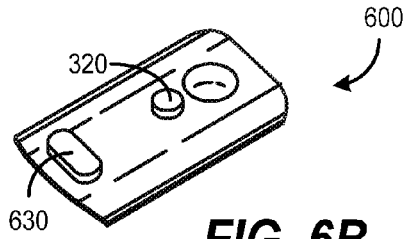
Figure 6C:
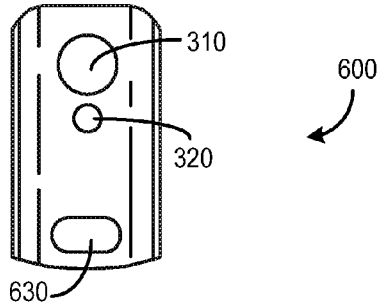

In another exemplary embodiment, shown in FIGS. 6A-6C, the sliding member 600 further can include a nub 630 that extends from the bottom of the sliding member 600 at an opposite end to the end having the handle 310. When the sliding member 600 is in the first position, as shown in FIG. 1B, the nub 630 is configured to fit into and plug the drink opening 210 to provide better protection against spillage.

Figure 7A:
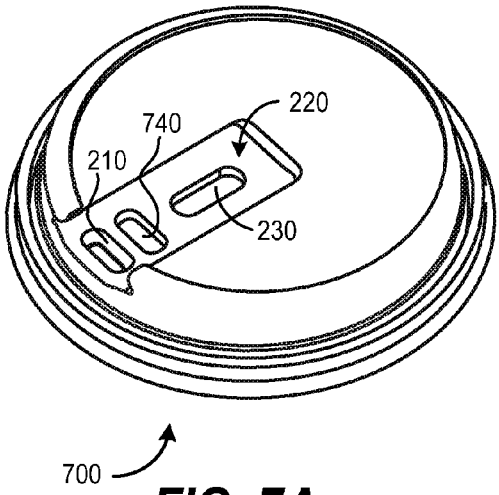
FIG. 7A and FIG. 7B are perspective and top views, respectively, of a cover portion of the lid in accordance with another embodiment.
Figure 7B:
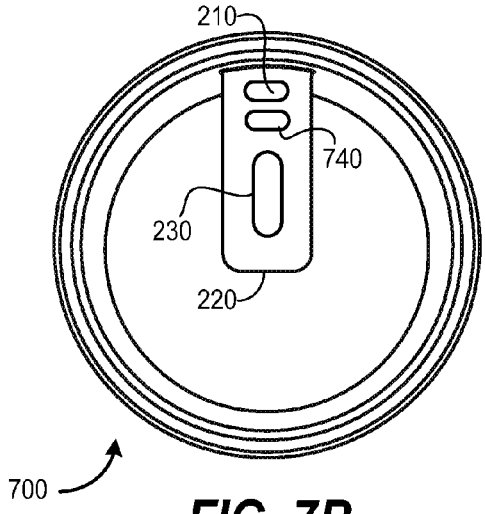

In another embodiment, shown in FIGS. 7A and 7B, the cover portion 700 can include a depression 740 in the trench 220 between the guide slot 230 and the drink opening 210. The depression 740 is configured to receive the nub 630 of the sliding member 600 when the sliding member 600 is in the second position, i.e., when the drink opening 210 is uncovered. In this manner, the sliding member 600 can remain flush with the trench 220 when the sliding member 600 is in the second position.

Figure 8A:
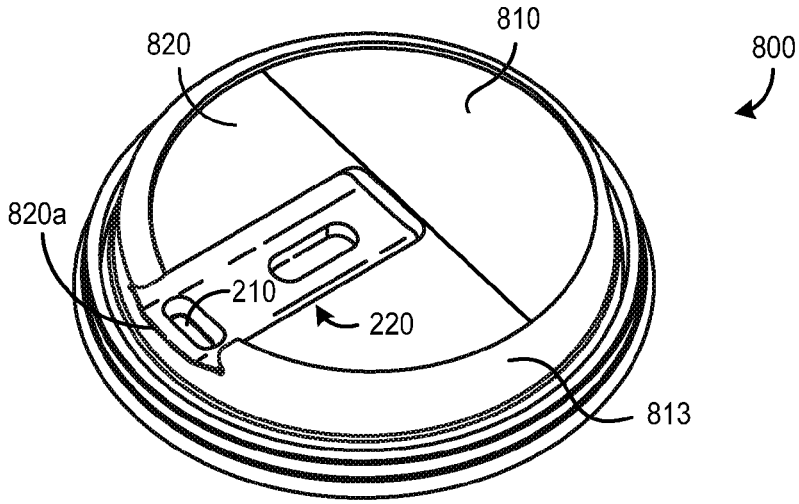
FIGS. 8A and 8B are perspective and side views, respectively, of the cover portion according to yet another embodiment.
Figure 8B:
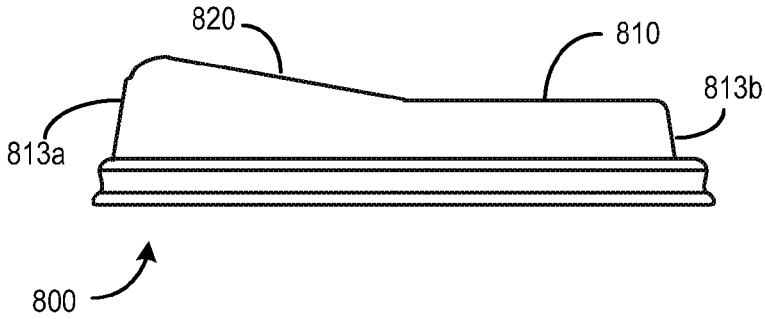

According to another embodiment, illustrated in FIGS. 8A and 8B, the cover portion 800 can include a flat region 810 and a sloped region 820. The trench 220, in one embodiment, is located in the sloped region 820 and the drink opening 210 is located at or near the highest point of the sloped region 820*a*. Accordingly, the annular side wall 813 can be of varying height. In particular, it can be higher at a location 813*a* adjacent to the drinking opening 210 and lower at a location 813*b* directly opposite to the drinking opening 210. This variation in height makes it easier for the user to place his or her mouth over the drink opening 210 to the drink without spillage. Moreover, because the drink opening 210 is located in the sloped region 820*a*, the user can better control the manner in which the beverage exits the drink opening 210. When the beverage is hot, this can help prevent the user from burning his or her lips.

Although the present invention has been described in accordance with the embodiments shown, one of ordinary skill in the art will readily recognize that there could be variations to the embodiments. For example, while the handle 310 has been described and illustrated as being located at an end of the sliding member 300 opposite an end that covers the drink opening 210, one skilled in the art would readily recognize that the handle 310 can be located in the middle of the sliding member 300 or near the end covering the drink opening 210. Those variations would be within the spirit and scope of the present invention. Accordingly, many modifications may be made by one of ordinary skill in the art without departing from the spirit and scope of the appended claims.

What is claimed is:

1. A disposable lid for a drinking cup comprising:

a cover portion having a generally circular periphery, the cover portion comprising:

a trench extending longitudinally from approximately a center of the cover portion to the periphery and along a top surface of the cover portion, the trench having an open end at the periphery of the cover portion and a floor;

a drink opening in the floor of the trench and adjacent to the periphery; and a guide slot on the floor of the trench; and a sliding member configured to slidably fit into the trench, wherein the sliding member comprises:

side portions joined by a central portion extending longitudinally along the sliding member, each of the side portions extending upwardly from the central portion of the sliding member such that an outer edge of each side portion is located above the central portion of the sliding member and a gap width between the outer edges of the side portions of the sliding member is greater than a width of a mouth of the trench;

a handle extending upwardly from a top surface of the sliding member; and a guide extending downwardly from the central portion of the sliding member, the guide configured to slidably fit into the guide slot on the floor of the trench;

wherein, the side portions of the sliding member secure the siding member to the cover portion and the guide slot allows the sliding member to move between a first position and a second position via the guide, such that when the sliding member is in the first position, the sliding member covers the drink opening and when the sliding member is in the second position, the sliding member uncovers the drink opening.

2. The lid of claim 1 wherein the trench comprises longitudinal side walls that extend downwardly and outwardly from the top surface of the cover portion to form an overhang portion such that a width of the floor of the trench is greater than the width of the mouth of the trench.

3. The lid of claim 2 wherein the sliding member is securely attached to the cover portion via the overhang portion.

4. The lid of claim 1 wherein the outer edges of the side portions extend upwardly at an obtuse angle from the central portion of the sliding member.

5. The lid of claim 1 wherein at least one side portion of the sliding member further comprises a ridge extending outwardly away from the central portion of the sliding member to form a ridge portion and the gap width between the outer edges of the side portions of the sliding member is greater than the width of the mouth of the trench.

6. The lid of claim 1 wherein the trench comprises longitudinal side walls that extend downwardly and outwardly from the top surface of the cover portion for a first distance, then extend inwardly toward a center of the trench for a second distance to form a notched portion, and then extend downwardly toward the floor of the trench.

7. The lid of claim 6 wherein at least one side portion of the sliding member further comprises a ridge extending outwardly away from the central portion of the sliding member to form a ridge portion, wherein the ridge portion of the sliding member fits in the notched portion of the trench and the gap width between the outer edges of the side portions of the sliding member is greater than the width of the mouth of the trench such that when the sliding member is in the trench, the sliding member is securely attached to the cover portion via the notched portion.

8. The lid of claim 1 wherein the trench comprises longitudinal side walls that extend downwardly and outwardly from the top surface of the cover portion to form an overhang portion and then curve downwardly toward the center of the trench such that the floor of the trench includes a curved surface.

9. The lid of claim of 8 wherein the central portion of the sliding member is curved to substantially match the curved surface of the floor of the trench.

10. The lid of claim 1 wherein the sliding member further comprises a nub such that when the sliding member is in the first position, the nub plugs the drink opening.

11. The lid of claim 10 wherein the cover portion further includes a depression in the floor of the trench that is configured to receive the nub when the sliding member is in the second position.

12. The lid of claim 1 wherein the cover portion further includes:

a flat region and a sloped region that slopes upward from the flat region, wherein the trench is located in the sloped region and the drink opening is located at or near a highest point of the sloped region; and an annular side wall depending from the periphery and extending downward to a mounting portion for securing the lid to a cup, wherein the side wall has a first height at a first location adjacent to the drink opening and a second height at a second location directly opposite to the first location, wherein the first height is greater than the second height.

13. A thermoformed plastic disposable lid for a drinking cup comprising:

a cover portion having a generally circular periphery, the cover portion comprising:

a trench extending longitudinally along a top surface of the cover portion, the trench comprising an open end at the periphery of the cover portion, a floor, and longitudinal side walls that extend downwardly and outwardly from the top surface of the cover portion to form an overhang portion such that a width of the floor of the trench is greater than a width of a mouth of the trench;

a drink opening in the floor of the trench and adjacent to the periphery; and a guide slot on the floor of the trench; and a sliding member configured to slidably fit into the trench, the sliding member comprising:

side portions joined by a central portion extending longitudinally along the sliding member, each of the side portions extending upwardly from the central portion of the sliding member such that an outer edge of each side portion is located above the central portion of the sliding member and a gap width between the outer edges of the side portions of the sliding member is greater than the width of the mouth of the trench such that when the sliding member is in the trench, the sliding member is securely attached to the cover portion via the overhang portion;

a handle extending upward from a top surface of the sliding member; and a guide extending downwardly from the central portion of the sliding member, the guide configured to slidably fit into the guide slot on the floor of the trench;

wherein, the guide slot allows the sliding member to move between a first position and a second position via the guide, such that when the sliding member is in the first position, the sliding member covers the drink opening and when the sliding member is in the second position, the sliding member uncovers the drink opening.

14. A thermoformed plastic disposable lid for a drinking cup comprising:

a cover portion having a generally circular periphery, the cover portion comprising:

a trench extending longitudinally along a top surface of the cover portion, the trench comprising an open end at the periphery of the cover portion, a floor, and longitudinal side walls that extend downwardly and outwardly from the top surface of the cover portion for a first distance, then extend inwardly toward a center of the trench for a second distance to form a notched portion, and then extend downwardly toward the floor of the trench;

a drink opening in the floor of the trench and adjacent to the periphery; and a guide slot on the floor of the trench; and a sliding member configured to slidably fit into the trench, the sliding member comprising:

side portions joined by a central portion extending longitudinally along the sliding member, each of the side portions extending upwardly from the central portion of the sliding member such that an outer edge of each side portion is located above the central portion of the sliding member and wherein at least one side portion of the sliding member further comprises a ridge extending outwardly away from the central portion of the sliding member to form a ridge portion, wherein the ridge portion of the sliding member fits in the notched portion of the trench and a gap width between the outer edges of the side portions of the sliding member is greater than a width of a mouth of the trench such that when the sliding member is in the trench, the sliding member is securely attached to the cover portion via the notched portion;

a handle extending upward from a top surface of the sliding member; and a guide extending downwardly from the central portion of the sliding member, the guide configured to slidably fit into the guide slot on the floor of the trench;

wherein, the guide slot allows the sliding member to move between a first position and a second position via the guide, such that when the sliding member is in the first position, the sliding member covers the drink opening and when the sliding member is in the second position, the sliding member uncovers the drink opening.

* * * * *